United States Patent [19]

Bunke

[11] 4,014,063

[45] Mar. 29, 1977

[54] APPARATUS FOR CLEANING TUBES AND FITTINGS

[75] Inventor: Edward J. Bunke, Montgomery, Ala.

[73] Assignee: The Raymond Lee Organization, Inc., New York, N.Y. ; a part interest

[22] Filed: Apr. 12, 1976

[21] Appl. No.: 675,952

[52] U.S. Cl. ..... 15/111; 15/104.04; 15/106; 15/160

[51] Int. Cl.[2] ..... A46B 5/02; B08B 9/02

[58] Field of Search ..... 15/67, 104.04, 106, 15/111, 160, 164, 200, 210 R, 211

[56] References Cited

UNITED STATES PATENTS

| | | | |
|---|---|---|---|
| 1,710,127 | 4/1929 | Vaughn | 15/106 |
| 1,838,958 | 12/1931 | Page | 15/106 |

*Primary Examiner*—Edward L. Roberts

[57] ABSTRACT

A hollow cylinder is open at one end and closed at the other. A first ring shaped cleaning brush having an outer diameter essentially equal to the inner diameter of the cylinder is disposed concentrically within the cylinder abutting the closed end and has a first inner diameter. A second ring shaped cleaning brush having a like outer diameter and a second inner diameter larger than the first inner diameter is disposed concentrically within the cylinder abutting the first brush. A third ring shaped cleaning brush having a like outer diameter and a third inner diameter larger than the second inner diameter, is disposed concentrically within the cylinder abutting the second brush and the open end of the cylinder. Each of said brushes having four equidistantly disposed radial slots therein. The slots, of adjacent brushes being aligned and dividing the brushes into four quadrants. An insert engages said cylinder, said insert has a first cylindrical brush having an outer diameter essentially equal to said first diameter and engages, the first cleaning brush, a second cylindrical brush having an outer diameter essentially equal to said second diameter and engaging the second cleaning brush, and a third cylindrical brush having an outer diameter essentially equal to third diameter and engaging the third cleaning brush.

4 Claims, 6 Drawing Figures

APPARATUS FOR CLEANING TUBES AND FITTINGS

SUMMARY OF THE INVENTION

This invention is directed towards apparatus for cleaning tubing and fittings having hollow circular cross sections differing in diameter. In accordance with the principals of the invention, a hollow cylinder open at one end and closed at the other is provided with a first ring shaped cleaning brush having an outer diameter essentially equal to the inner diameter of the cylinder and disposed concentrically within the cylinder abutting the closed end, the first brush having a first inner diameter. Said first brush has four equidistantly disposed radial slots therein dividing the first brush into four quadrants. A second ring shaped cleaning brush having a like outer diameter and a second inner diameter is larger than the first diameter. The second brush is disposed concentrically within the cylinder abutting the first brush, said second brush having four equidistantly disposed radial slots therein aligned with the four slots in the first brush and dividing the second brush into four quadrants. A third ring shaped cleaning brush having a like outer diameter and a third inner diameter larger than the second inner diameter is disposed concentrically within the cylinder abutting the second brush and the open end of the cylinder, said third brush having four equidistantly disposed radial slots therein aligned with the four slots in the second brush and dividing the third brush into four quadrants.

In use a tube or fitting of appropriate diameter is inserted in the cylinder and the cylinder is rotated with respect to the tube or fitting until brush cleaning action is completed. The tube or fitting is then removed.

A reamer device which in cross section has a cruciform shape can be removably disposed in the aligned radial slots of all the brushes whereby a reaming action at the tube or fitting can be carried out as above.

Additional apparatus engagable with the cylinder and brushes can be used to clean the brushes and remove debris and the like previously accumulated thereon by the brushing action previously described.

BRIEF DESCRIPTION OF THE DRAWINGS

FIG. 6 is a view taken along line 6—6 in FIG. 1.

DETAILED DESCRIPTION OF PREFERRED EMBODIMENT

Figure 1:
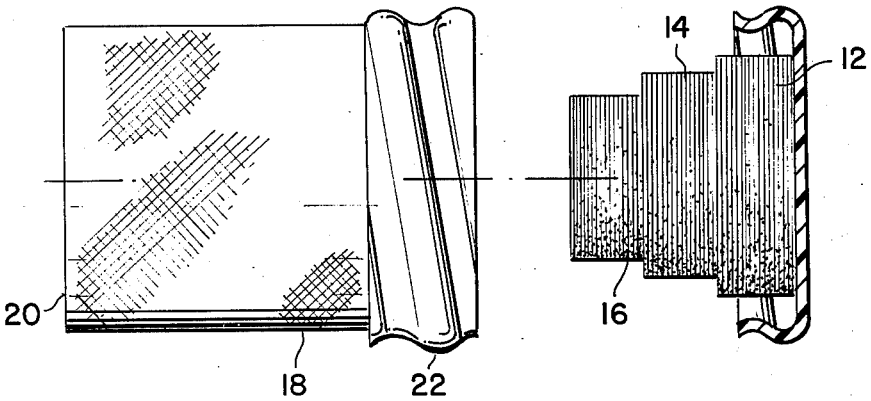
FIG. 1 is an exploded view of the invention.
Figure 5:
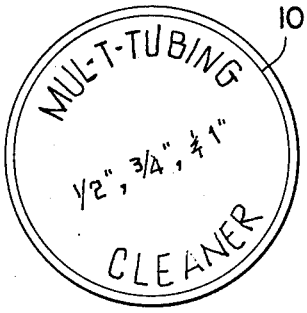
FIG. 5 is a view taken along line 5—5 in FIG. 1.
Figure 2:
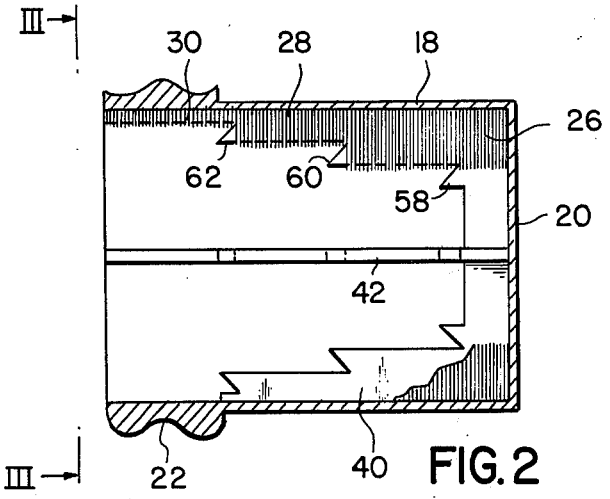
FIG. 2 is a cross sectional side view of a portion of the structure shown in FIG. 1.
Figure 3:
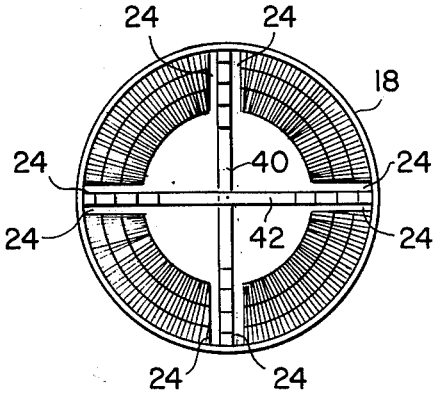
FIG. 3 is a view taken along line 3—3 in FIG. 2.
Figure 4:
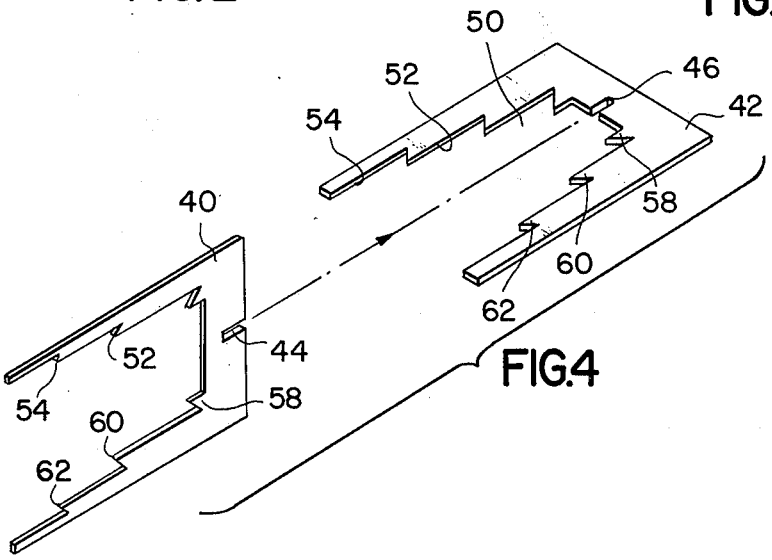
FIG. 4 is a detail view of certain parts shown in FIGS. 2 and 3.

Referring now to FIGS. 1–6, cylindrical cap 10 has a first cylindrical brush 12 having a first outer diameter secured thereto, a second cylindrical brush 14 having a second and smaller outer diameter also secured thereto as well as a third cylindrical brush 16 having a third and even smaller outer diameter also secured thereto. The brushes are disposed end to end along a common axis aligned with the axis of the cap. Typical brush diameters are marked in the exposed face of the cap.

A hollow cylinder 18 having one closed end 20 has an opposite open end having a peripheral outer thread 22 adapted to threadedly engage the interior of cap 10. A first ring shaped cleaning brush 26 having a first inner diameter essentially equal to the outer diameter of brush 16 is secured in the cylinder abutting the closed end. The outer surface of the brush 26 is in contact with the inner surface of the cylinder; the axis of brush 26 is aligned with the axis of the cylinder 18; and brush 26 has four equidistantly disposed radial slots 24 dividing the brush into four quadrants.

A second ring shaped brush 28 having a second inner diameter essentially equal to the outer diameter of brush 14 is secured in the cylinder in the same manner as brush 16 except that brush 28 abuts brush 26.

Brush 28 also has radial slots 24 dividing the brush into four quadrants.

A third ring shaped brush 30 having a thread inner diameter essentially equal to the outer diameter of brush 12 is secured in the cylinder in the same manner as brush 26 except that brush 30 abuts brush 28. Brush 30 also has radial slots 24 dividing the brush into four quadrants.

Two flat plates 40 and 42 each have cut out regions and are notched at 44 and 46 to be detachably joined at right angles to each other and to fit slidably into the slots 24 to form a detachable reamer. These plates in cross section define a cruciform shape. These plates each have three cut out regions 50, 52 and 54 which are aligned with the inner diameter of the brushes 26, 28 and 30 and which have peripherally disposed reaming edges 56, 58 and 60.

The invention can then be used as previously explained.

While the invention has been described with particular reference to the drawings, the protection sought is to be limited only by the terms of the claims that follow.

I claim:

1. Apparatus for cleaning tubing and fittings having hollow circular cross sections differing in diameter, said apparatus comprising:

a hollow cylinder open at one end and closed at the other;

a first ring shaped cleaning brush having an outer diameter essentially equal to the inner diameter of the cylinder and disposed concentrically within the cylinder abutting the closed end and having a first inner diameter said first brush having four equidistantly disposed radial slots therein dividing the first brush into four quadrants;

a second ring shaped cleaning brush having a like outer diameter and a second inner diameter larger than the first inner diameter, said second brush being disposed concentrically within the cylinder abutting the first brush, said second brush having four equidistantly disposed radial slots therein aligned with the four slots in the first brush and dividing the second brush into four quadrants; and a third ring shaped cleaning brush having a like outer diameter and a third inner diameter larger than the second inner diameter, said third brush being disposed concentrically within the cylinder abutting the second brush and the open end of the cylinder, said third brush having four equidistantly disposed radial slots therein aligned with the four slots in the second brush and dividing the third brush into four quadrants.

2. Apparatus of claim 1 further including a reamer device which in cross section has a cruciform shape, said device being removably disposed in the aligned radial slots of all of said brushes.

3. Apparatus of claim 2 wherein said reamer defines first, second and third cylindrical openings, each opening being aligned with the inner opening of the corresponding brush and having a diameter essentially equal to the inner diameter of the corresponding brush, each opening having a front disposed reaming edge.

4. Apparatus of claim 1 further including an insert for engaging said cylinder, said insert having a first cylindrical brush having an outer diameter essentially equal to said first diameter and engages, the first cleaner, brush, a second cylindrical brush having an outer diameter essentially equal to said second diameter and engaging the second cleaning brush, and a third cylindrical brush having an outer diameter essentially equal to said third diameter and engaging the third cleaning brush.

* * * * *